United States Patent [19]

Leong

[11] Patent Number: 4,738,484

[45] Date of Patent: Apr. 19, 1988

[54] TABLE AND STOOL ASSEMBLY

[75] Inventor: Po S. Leong, Canoga Park, Calif.

[73] Assignee: Walter Fleisher Company, Van Nuys, Calif.

[21] Appl. No.: 83,148

[22] Filed: Aug. 10, 1987

[51] Int. Cl.[4] ..... A47B 37/04

[52] U.S. Cl. ..... 297/159; 297/172; D6/337

[58] Field of Search ..... 297/135, 157, 159, 172, 297/170; D6/337

[56] References Cited

U.S. PATENT DOCUMENTS

| | | | |
|---|---|---|---|
| D. 172,195 | 5/1954 | Richardson | 297/159 X |
| D. 190,744 | 6/1961 | Guice | 297/159 X |
| D. 244,409 | 5/1977 | Arnold | D6/337 |
| D. 277,442 | 2/1985 | Crowell | D6/337 X |
| D. 280,367 | 9/1985 | Reamer, Jr. | D6/337 |
| D. 286,953 | 12/1986 | Mayo | D6/337 |
| 2,800,379 | 7/1957 | Smithers | 297/157 X |
| 3,266,840 | 8/1966 | D'Estrube | 297/157 |
| 4,522,443 | 6/1985 | Blankenburg | 297/157 |
| 4,607,880 | 8/1986 | Gastebled | 297/157 |

*Primary Examiner*—Peter A. Aschenbrenner
*Attorney, Agent, or Firm*—Keith D. Beecher

[57] ABSTRACT

A table and stool assembly formed of four identical U-shaped tubular brackets. Each bracket has a central section and two parallel legs extending perpendicular to the central section, with each leg having an end section extending perpendicular to the central section. The four brackets are bolted together with the legs extending upwardly, and with the central portions of the four brackets forming a rectangular base for the assembly. A table top is mounted to the end sections of one of the legs of the four brackets, and two stool seats are mounted on the end sections of the other legs of the brackets.

4 Claims, 1 Drawing Sheet

TABLE AND STOOL ASSEMBLY

BACKGROUND OF THE INVENTION

A simplified table and stool assembly is provided which in the illustrated embodiment combines a table and two stools. The table top and the stool seats are supported by four identical tubular brackets which provide unified strength and simplicity for the assembly.

The table and stool assembly of the invention may be produced in different sizes to fit adults and children. When disassembled, all of the components may be fitted flat into a small container. The assembly provides a stable and rigid structure of unified strength.

It is, accordingly, an objective of the present invention to provide a simple and inexpensive table and stool assembly, which comprises a unified, stable and rigid support structure formed of a minimum of components.

A further objective of the invention is to provide such an improved assembly which is simple to set up and take down; and which when disassembled fits flat into a small container

DETAILED DESCRIPTION OF THE ILLUSTRATED EMBODIMENT

Figure 2:
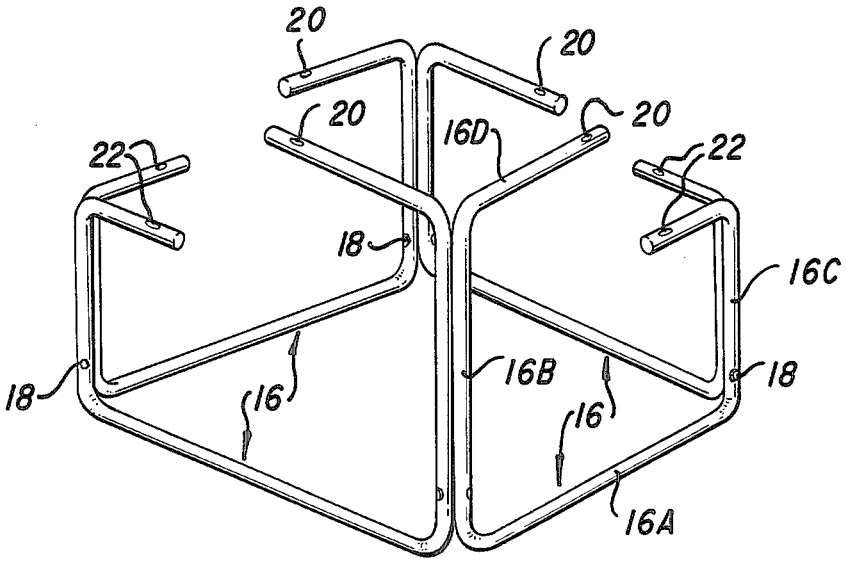
FIG. 2 is a perspective view of the support structure with the table top and stool seats removed to assist in the understanding of the support structure.

As shown in FIG. 2, the assembly of the invention includes a support structure which is made up of four identical tubular components 16. Each of the tubular components 16 includes a central section 16A and two leg sections 16B and 16C extending perpendicular to one another from each end of the central section 16A, with the leg sections extending perpendicular to the central section. In the illustrated embodiment, the leg section 16C is made shorter than the leg section 16B.

As shown in FIG. 2, leg 16B has an end section 16D which is bent to extend perpendicular to leg 16B and parallel to the central section 16A. Likewise, leg 16C has an end section 16E which extends perpendicular to leg section 16C and parallel to end section 16A.

Figure 1:
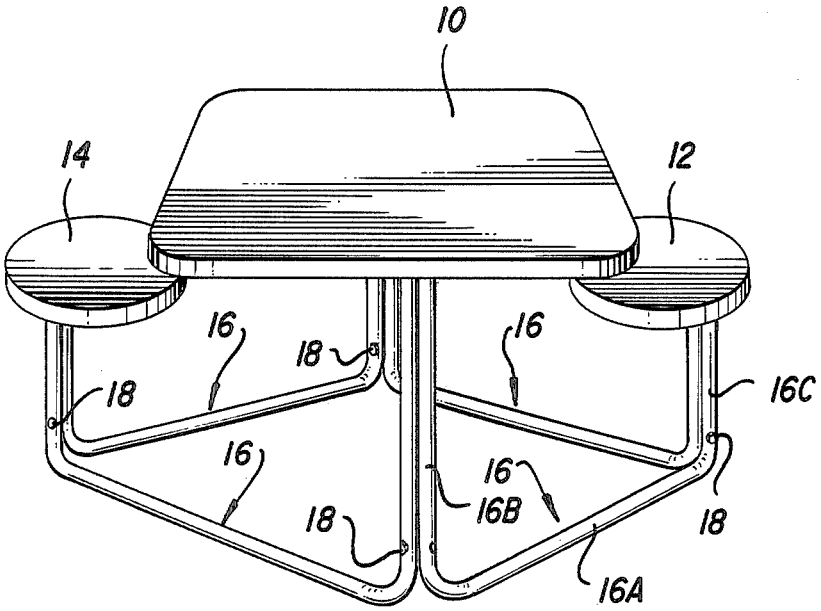
FIG. 1 is a perspective representation of the table and stool assembly of the invention, in one of its embodiments.

The four brackets 16 are held together by bolts 18 extending through adjacent leg sections, so that the central sections 16A form a rectangular base for the assembly, with the leg sections extending upwardly from the base, and with the brackets being held adjacent to one another, as shown in FIGS. 1 and 2.

A table top 10 is mounted on the end section 16D, and is held in place by appropriate screws extending through holes 20. Likewise, stool seats 12 and 14 are mounted on the end sections 16E, and they are held in place by screws extending through holes 22.

The invention provides, therefore, an improved, simplified, rigid and stable table and stool assembly. The assembly is easy to set up and to take down. Also, the various components which make up the assembly may be mounted flat in a relatively small container.

It will be appreciated that while a particular embodiment of the invention has been shown and described, modifications may be made. It is intended in the claims to cover all modifications which come within the true spirit and scope of the invention.

I claim:

1. A table and stool assembly comprising: four tubular U-shaped brackets, each having a central portion and two parallel legs at each end thereof extending perpendicular to the central portion, with each leg having an end section extending parallel to the central portion; means for securing the four brackets together with the legs thereof extending upwardly, and with the central portions forming a rectangular base for the assembly; a table top mounted on the end sections of first ones of the legs of the brackets; and at least one stool seat mounted on the end sections of at least two of the other legs of the brackets.

2. The table and stool assembly defined in claim 1, and which includes two stool seats mounted respectively on the two end sections of the other legs of the brackets.

3. The table and stool assembly defined in claim 2, in which the other legs of the brackets are shorter than the first legs so that the stool seats are displaced down from the plane of the table top.

4. The table and stool assembly defined in claim 1, in which the securing means comprises a plurality of bolts respectively extending through adjacent legs of the four brackets.

* * * * *